US007895034B2

(12) United States Patent
You

(10) Patent No.: US 7,895,034 B2
(45) Date of Patent: Feb. 22, 2011

(54) AUDIO ENCODING SYSTEM

(75) Inventor: Yuli You, Thousand Oaks, CA (US)

(73) Assignee: Digital Rise Technology Co., Ltd., Guangzhou, Guangdong (CN)

( * ) Notice: Subject to any disclaimer, the term of this patent is extended or adjusted under 35 U.S.C. 154(b) by 1058 days.

(21) Appl. No.: 11/669,346

(22) Filed: Jan. 31, 2007

(65) Prior Publication Data

US 2007/0124141 A1 May 31, 2007

Related U.S. Application Data

(63) Continuation-in-part of application No. 11/558,917, filed on Nov. 12, 2006, and a continuation-in-part of application No. 11/029,722, filed on Jan. 4, 2005, now Pat. No. 7,630,902.

(60) Provisional application No. 60/822,760, filed on Aug. 18, 2006, provisional application No. 60/610,674, filed on Sep. 17, 2004.

(51) Int. Cl.
*G10L 19/00* (2006.01)

(52) U.S. Cl. ..... 704/200.1; 704/200; 704/222

(58) Field of Classification Search ..... 704/200, 704/200.1, 203, 220, 222, 229, 230, 211, 704/221, 500–504; 714/752
See application file for complete search history.

(56) References Cited

U.S. PATENT DOCUMENTS 5,214,742 A * 5/1993 Edler ..... 704/203
5,321,729 A 6/1994 Schroder et al.
5,812,971 A * 9/1998 Herre ..... 704/230
5,848,391 A 12/1998 Bosi et al.
6,226,608 B1 5/2001 Fielder et al.
6,357,029 B1 * 3/2002 Sinha et al. ..... 714/752
7,516,064 B2 * 4/2009 Vinton et al. ..... 704/206
2005/0192765 A1 9/2005 Slothers et al.

FOREIGN PATENT DOCUMENTS

WO WO/9245153 9/1992

OTHER PUBLICATIONS

Ted Painter and Andreas Spanias, "Perceptual Coding of Digital Audio", Proceedings of The IEEE, vol. 88, No. 4, Apr. 2000, pp. 451-513.

* cited by examiner

*Primary Examiner*—Huyen X. Vo
(74) *Attorney, Agent, or Firm*—Joseph G. Swan, P.C.

(57) ABSTRACT

Provided are, among other things, systems, methods and techniques for encoding an audio signal, in which is obtained a sampled audio signal which has been divided into frames. The location of a transient within one of the frames is identified, and transform data samples are generated by performing multi-resolution filter bank analysis on the frame data, including filtering at different resolutions for different portions of the frame that includes the transient. Quantization data are generated by quantizing the transform data samples using variable numbers of bits based on a psychoacoustical model, and the quantization data are grouped into variable-length segments based on magnitudes of the quantization data. A code book is assigned to each of the variable-length segments, and the quantization data in each of the variable-length segments are encoded using the code book assigned to such variable-length segment.

20 Claims, 3 Drawing Sheets

AUDIO ENCODING SYSTEM

This application is a continuation-in-part of U.S. patent application Ser. No. 11/558,917, filed Nov. 12, 2006, and titled "Variable-Resolution Processing of Frame-Based Data" (the '917 Application), which in turn claims the benefit of U.S. Provisional Patent Application Ser. No. 60/822,760, filed on Aug. 18, 2006, and titled "Variable-Resolution Filtering" (the '760 Application); is a continuation-in-part of U.S. patent application Ser. No. 11/029,722, filed Jan. 4, 2005, and titled "Apparatus and Methods for Multichannel Digital Audio Coding" (the '722 Application, which is now U.S. Pat. No. 7,630,902), which in turn claims the benefit of U.S. Provisional Patent Application Ser. No. 60/610,674, filed on Sep. 17, 2004, and also titled "Apparatus and Methods for Multichannel Digital Audio Coding"; and also directly claims the benefit of the '760 Application. Each of the foregoing applications is incorporated by reference herein as though set forth herein in full.

FIELD OF THE INVENTION

The present invention pertains to systems, methods and techniques for encoding audio signals.

BACKGROUND

A variety of different techniques for encoding audio signals exist. However, improvements in performance, quality and compression are continuously desirable.

SUMMARY OF THE INVENTION

The present invention addresses this need by, among other techniques, providing an overall audio encoding technique that uses variable resolution within transient frames and generates variable-length code book segments based on magnitudes of the quantization data.

Thus, in one aspect the invention is directed to systems, methods and techniques for encoding an audio signal. A sampled audio signal, divided into frames, is obtained. The location of a transient within one of the frames is identified, and transform data samples are generated by performing multi-resolution filter bank analysis on the frame data, including filtering at different resolutions for different portions of the frame that includes the transient. Quantization data are generated by quantizing the transform data samples using variable numbers of bits based on a psychoacoustical model, and the quantization data are grouped into variable-length segments based on magnitudes of the quantization data. A code book is assigned to each of the variable-length segments, and the quantization data in each of the variable-length segments are encoded using the code book assigned to such variable-length segment.

By virtue of the foregoing arrangement, it often is possible to simultaneously achieve more accurate encoding of audio data while representing such data using a fewer number of bits.

The foregoing summary is intended merely to provide a brief description of certain aspects of the invention. A more complete understanding of the invention can be obtained by referring to the claims and the following detailed description of the preferred embodiments in connection with the accompanying figures.

DESCRIPTION OF THE PREFERRED EMBODIMENT(S)

The present invention pertains to systems, methods and techniques for encoding audio signals, e.g., for subsequent storage or transmission. Applications in which the present invention may be used include, but are not limited to: digital audio broadcasting, digital television (satellite, terrestrial and/or cable broadcasting), home theatre, digital theatre, laser video disc player, content streaming on the Internet and personal audio players.

Figure 1:
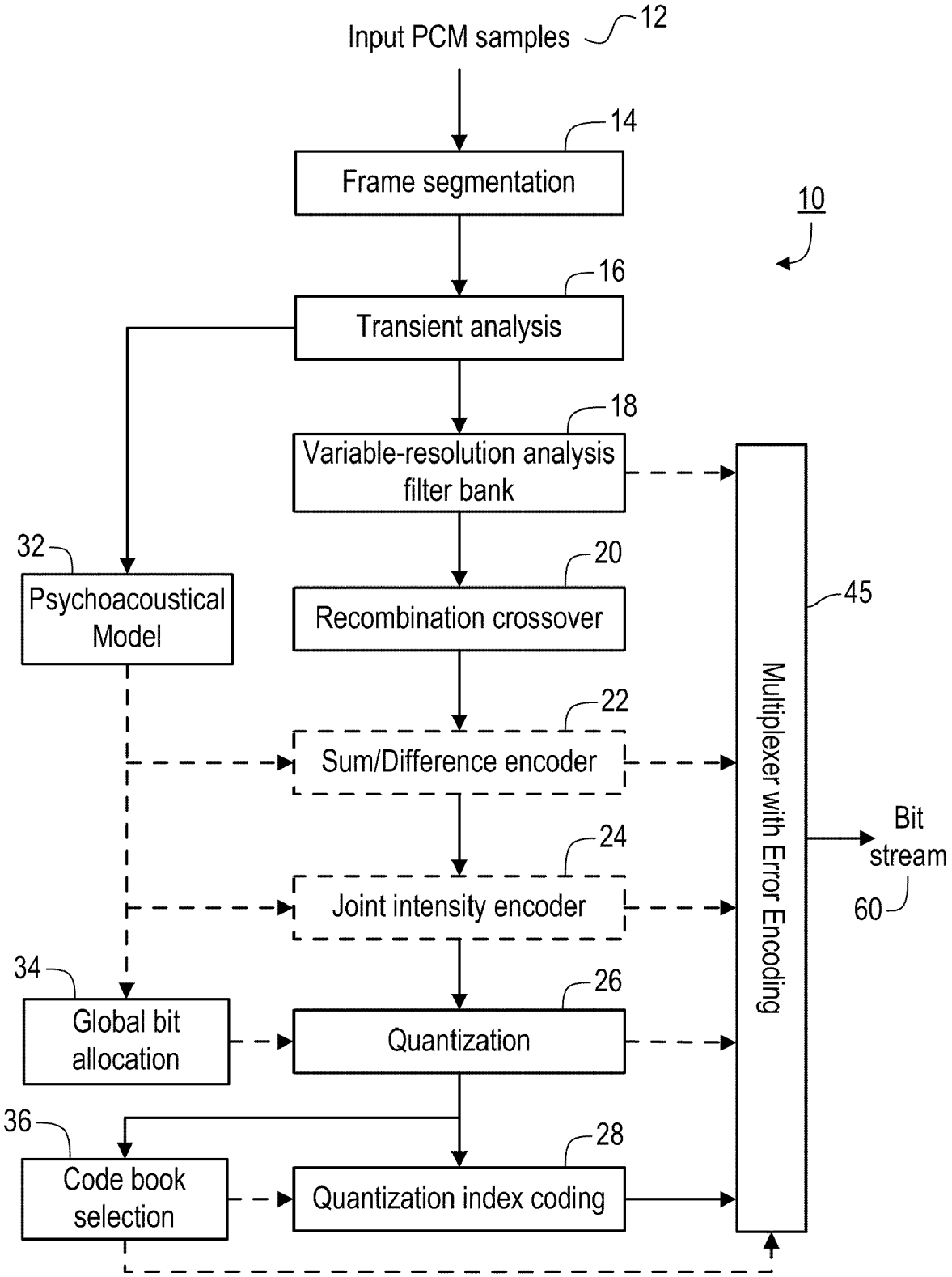
FIG. 1 is a block diagram of an audio signal encoder according to a representative embodiment of the present invention.

FIG. 1 is a block diagram of an audio signal encoding system 10 according to a representative embodiment of the present invention. In a representative sub-embodiment, the individual sections or components illustrated in FIG. 1 are implemented entirely in computer-executable code, as described below. However, in alternate embodiments any or all of such sections or components may be implemented in any of the other ways discussed herein.

Initially, pulse-coded modulation (PCM) signals 12, corresponding to time samples of an original audio signal, are input into frame segmentation section 14. In this regard, the original audio signal typically will consist of multiple channels, e.g., left and right channels for ordinary stereo, or 5-7 normal channels and one low-frequency effect (LFE) channel for surround sound. A LFE channel typically has limited bandwidth (e.g., less than 120 Hz) and volume that is higher than a normal channel. Throughout this description, a given channel configuration is represented as x.y, where x represents the number of normal channels and y represents the number of LFE channels. Thus, ordinary stereo would be represented in its 2.0 and typical conventional surround sound would be represented as 5.1, 6.1 or 7.1.

The preferred embodiments of the present invention support channel configurations of up to 64.3 and sample frequencies from 8 kiloHertz (kHz) to 192 kHz, including 44.1 kHz and 48 kHz, with a precision of at least 24 bits. Generally speaking, each channel is processed independently of the others, except as otherwise noted herein.

The PCM signals 12 may be input into system 10 from an external source or instead may be generated internally by system 10, e.g., by sampling an original audio signal.

In frame segmentation section 14, the PCM samples 12 for each channel are divided into a sequence of contiguous frames in the time domain. In this regard, a frame is considered to be a base data unit for processing purposes in the techniques of the present invention. Preferably, each such frame has a fixed number of samples, selected from a relatively small set of frame sizes, with the selected frame size for any particular time interval depending, e.g., upon the sampling rate and the amount of delay that can be tolerated between frames. More preferably, each frame includes 128, 256, 512 or 1,024 samples, with longer frames being preferred except in situations where reduction of delay is important. In most of the examples discussed below, it is assumed that each frame consists of 1,024 samples. However, such examples should not be taken as limiting.

Each frame of data samples output from frame segmentation section 14 is input into transient analysis section 16, which determines whether the input frame of PCM samples contains a signal transient, which preferably is defined as a sudden and quick rise (attack) or fall of signal energy. Based on such detection, each frame is then classified as a transient frame (i.e. one that includes a transient) or a quasistationary frame (i.e., one that does not include a transient). In addition, transient analysis section 16 identifies the location and duration of each transient signal, and then uses that information to identify "transient segments". Any known transient-detection method can be employed, including any of the transient-detection techniques described in the '722 Application.

The term "transient segment", as used herein, refers to a portion of a signal that has the same or similar statistical properties. Thus, a quasistationary frame generally consists of a single transient segment, while a transient frame ordinarily will consist of two or three transient segments. For example, if only an attack or fall of a transient occurs in a frame, then the transient frame generally will have two transient segments: one covering the portion of the frame before the attack or fall and another covering the portion of the frame after the attack or fall. If both an attack and fall occur in a transient frame, then three transient segments generally will exist, each one covering the portion of the frame as segmented by the attack and fall, respectively. The frame-based data and the transient-detection information are then provided to filter bank 18.

The variable-resolution analysis filter bank 18 decomposes the audio PCM samples of each channel audio into subband signals, with the nature of the subband depending upon the transform technique that is used. In this regard, although any of a variety of different transform techniques may be used by filter bank 18, in the preferred embodiments the transform is unitary and sinusoidal-based. More preferably, filter bank 18 uses the discrete cosine transform (DCT) or the modified discrete cosine transform (MDCT), as described in more detail in the '722 Application. In most of the examples described herein, it is assumed that MDCT is used. Accordingly, in the preferred embodiments, the subband signals constitute, for each MDCT block, a number of subband samples, each corresponding to a different frequency of subband; in addition, due to the unitary nature of the transform, the number of subband samples is equal to the number of time-domain samples that were processed by the MDCT.

In addition, in the preferred embodiments the time-frequency resolution of the filter bank 18 is controlled based on the transient detection results received from transient analysis section 16. More preferably, filter bank 18 uses the techniques described in the '917 Application.

Generally speaking, that technique uses a single long transform block to cover each quasistationary frame and multiple identical shorter transform blocks to cover each transient frame. In a representative example, the frame size is 1,024 samples, each quasistationary frame is considered to consist of a single primary block (of 1,024 samples), and each transient frame is considered to consist of eight primary blocks (having 128 samples each). In order to avoid boundary effects, the MDCT block is larger than the primary block and, more preferably, twice the size of the primary block, so the long MDCT block consists of 2,048 samples and the short MDCT block consists of 256 samples.

Prior to applying the MDCT, a window function is applied to each MDCT block for the purpose of shaping the frequency responses of the individual filters. Because only a single long MDCT block is used for the quasistationary frames, a single window function is used, although its particular shape preferably depends upon the window functions used in adjacent frames, so as to satisfy the perfect reconstruction requirements. On the other hand, unlike conventional techniques, the techniques of the preferred embodiments use different window functions within a single transient frame. More preferably, such window functions are selected so as to provide at least two levels of resolution within the transient frame, while using a single transform (e.g., MDCT) block size within the frame.

As a result, e.g., a higher time-domain resolution (at the cost of lower frequency-domain resolution) can be achieved in the vicinity of the transient signal, and a higher frequency-domain resolution (at the cost of lower time-domain resolution) can be achieved in other (i.e., more stationary) portions of the transient frame. Moreover, by holding transform block size constant, the foregoing advantages generally can be achieved without complicating the processing structure.

In the preferred embodiments, in addition to conventional window functions, the following new "brief" window function WIN_SHORT_BRIEF2BRIEF is introduced:

$$w(n) = \begin{cases} 0, & 0 \le n < \frac{S-B}{2}; \\ \sin\left[\frac{\pi}{2B}\left(\left(n - \frac{S-B}{2}\right) + \frac{1}{2}\right)\right], & \frac{S-B}{2} \le n < \frac{S+B}{2}; \\ 1, & \frac{S+B}{2} \le n < \frac{3S-B}{2}; \\ \sin\left[\frac{\pi}{2B}\left(\left(n - \frac{3S-3B}{2}\right) + \frac{1}{2}\right)\right], & \frac{3S-B}{2} \le n < \frac{3S+B}{2}; \\ 0, & \frac{3S+B}{2} \le n < 2S. \end{cases}$$

where S is the short primary block size (e.g., 128 samples) and B is the brief block size (e.g., B=32). As discussed in more detail in the '917 Application, additional transition window functions preferably also are used in order to satisfy the perfect reconstruction requirements.

It is noted that other specific forms of "brief" window functions instead may be used, as also discussed in more detail in the '917 Application. However, in the preferred embodiments of the invention, the "brief" window function used has more of its energy concentrated in a smaller portion of the transform block, as compared with other window functions used in the other (e.g., more stationary) portions of the transient frame. In fact, in certain embodiments, a number of the function values are 0, thereby preserving the central, or primary block of, sample values.

In recombination crossover section 20, the subband samples for the current frame of the current channel preferably are rearranged so as to group together samples within the same transient segment that correspond to the same subband. In a frame with a long MDCT (i.e., a quasistationary frame), subband samples already are arranged in frequency ascending order, e.g., from subband 0 to subband 1023. Because subband samples of the MDCT are arranged in the natural order, the recombination crossover is not applied in frames with a long MDCT.

However, when a frame is made up of nNumBlocksPerFrm short MDCT blocks (i.e., a transient frame), the subband samples for each short MDCT are arranged in frequency-ascending order, e.g., from subband 0 to subband 127. The groups of such subband samples, in turn, are arranged in time order, thereby forming the natural order of subband samples from 0 to 1023.

In recombination crossover section 20, recombination crossover is applied to these subband samples, by arranging samples with the same frequency in each transitent segment together and then arranging them in frequency-ascending order. The results often is to reduce the number of bits required for transmission.

An example of the natural order for frame having three transient segments and eight short MDCT blocks is as follows:

| | | Transient Segment | | | | | | | |
|---|---|---|---|---|---|---|---|---|---|
| | | 0 | | | 1 | | | 2 | |
| MDCT | | 0 | 1 | 2 | 3 | 4 | 5 | 6 | 7 |
| Critical Band | 0 | 0 | 128 | 256 | 384 | 512 | 640 | 768 | 896 |
| | | 1 | 129 | 257 | 385 | 513 | 641 | 769 | 897 |
| | | 2 | 130 | 258 | 386 | | | | |
| | | 3 | 131 | 259 | | | | | |
| | 1 | 4 | 132 | | | | | | |
| | | 5 | 133 | | | | | | |
| | | 6 | | | | | | | |
| | | 7 | | | | | | | |
| | | | | | | . | | | |
| | | | | | | . | | | |
| | | | | | | . | | | |
| | n | 86 | 214 | | | | | | |
| | | 87 | | | | | | | |
| | | | | | | . | | | |
| | | | | | | . | | | |
| | | | | | | . | | | |
| | | 127 | 255 | 383 | 511 | 639 | 767 | 895 | 1023 |

Once again, the subband samples in the natural order is [0 . . . 1023]. The corresponding data arrangement after application of recombination crossover is as follows:

| | | Transient Segment | | | | | | | |
|---|---|---|---|---|---|---|---|---|---|
| | | 0 | | | 1 | | | 2 | |
| MDCT | | 0 | 1 | 2 | 3 | 4 | 5 | 6 | 7 |
| Critical Band | 0 | 0 | 1 | 256 | 257 | 258 | 640 | 641 | 642 |
| | | 2 | 3 | 259 | 300 | 301 | 643 | 644 | 645 |
| | | 4 | 5 | 302 | 303 | | | | |
| | | 6 | 7 | 305 | | | | | |
| | 1 | 8 | 9 | | | | | | |

-continued

| | | Transient Segment | | | | | | | |
|---|---|---|---|---|---|---|---|---|---|
| | | 0 | | | 1 | | | 2 | |
| MDCT | | 0 | 1 | 2 | 3 | 4 | 5 | 6 | 7 |
| | | 10 | 11 | | | | | | |
| | | 12 | | | | | | | |
| | | 14 | | | | | | | |
| | | | | | | . | | | |
| | | | | | | . | | | |
| | | | | | | . | | | |
| | n | 172 | | | | 173 | | | |
| | | 174 | | | | | | | |
| | | | | | | . | | | |
| | | | | | | . | | | |
| | | | | | | . | | | |
| | | 254 | 255 | 637 | 638 | 639 | 1024 | 1022 | 1023 |

The linear sequence for the subband samples in the recombination crossover order is [0, 2, 4, . . . , 254, 1, 3, 5, . . . , 255, 256, 259, 302, . . . , 637, . . . ].

As used herein, the "critical band" refers to the frequency resolution of the human ear, i.e., the bandwidth Δf within which the human ear is not capable of distinguishing different frequencies. The bandwidth Δf rises along with the frequency f, with relationship between f and Δf being approximately exponential. Each critical band can be represent as a number of adjacent subband samples of the filter bank. For example, the critical bands for a short (128-sample) MDCT typically range from 4 subband samples in width at the lowest frequencies to 42 subband samples in width at the highest frequencies.

Psychoacoustical model 32 provides the noise-masking thresholds of the human ear. The basic concept underlying psychoacoustical model 32 is that there are thresholds in the human auditory system. Below these values (masking thresholds), audio signals cannot be heard. As a result, it is unnecessary to transmit this part of the information to the decoder. The purpose of psychoacoustical model 32 is to provide these threshold values.

Existing general psychoacoustical models can be used, such as the two psychoacoustical models from MPGE. In the preferred embodiments of the present invention, psychoacoustical model 32 outputs a masking threshold for each quantization unit (as defined below).

Optional sum/difference encoder 22 uses a particular joint channel encoding technique. Preferably, encoder 22 transforms subband samples of the left/right channel pair into a sum/difference channel pair as follows:

Sum channel=0.5*(left channel+right channel); and

Difference channel=0.5*(left channel−right channel).

Accordingly, during decoding, the reconstruction of the subband samples in the left/right channel is as follows:

Left channel=sum channel+difference channel; and

Right channel=sum channel−difference channel.

Optional joint intensity encoder 24 encodes high-frequency components in a joint channel by using the acoustic image localization characteristic of the human ear at high frequency. The psychoacoustical model indicates that the sensation of the human ear to the spatial acoustic image at high frequency is mostly defined by the relative strength of the left/right audio signals and less defined by the respective frequency components. This is the theoretic foundation of joint intensity encoding. The following is a simple technique for joint intensity encoding.

For two or more channels to be combined, corresponding subband samples are added across channels and the totals replace the subband samples in one of the original source channels (e.g., the left channel), referred to as the joint subband samples. Then, for each quantization unit, the power is adjusted so as to match the power of such original source channel, retaining a scaling factor for each quantization unit of each channel. Finally, only the power-adjusted joint subband samples and the scaling factors for the quantization units in each channel are retained and transmitted. For example, if $E_S$ is the power of joint quantization unit in the source channel, and $E_J$ is the power of joint quantization unit in joint channel, then the scale factor can be calculated as follows:

$$k = \sqrt{\frac{E_J}{E_S}}$$

Global bit allocation section 34 assigns a number of bits to each quantization unit. In this regard, a "quantization unit" preferably consists of a rectangle of subband samples bounded by the critical band in the frequency domain and by the transient segment in the time domain. All subband samples in this rectangle belong to the same quantization unit.

Serial numbers of these samples can be different, e.g., because in the preferred embodiments of the invention there are two types of subband sample arranging orders (i.e., natural order and crossover order), but they preferably represent subband samples of the same group nevertheless. In one example, the first quantization unit is made up of subband samples 0, 1, 2, 3, 128, 129, 130, and 131. However, the subband samples' serial numbers of the first quantization unit become 0, 1, 2, 3, 4, 5, 6, and 7. The two groups of different serial numbers represent the same subband samples.

In order to reduce the quantization noise power to a value that is lower than each masking threshold value, global bit allocation section 34 distributes all of the available bits for each frame among the quantization units in the frame. Preferably, quantization noise power of each quantization unit and the number of bits assigned to it are controlled by adjusting the quantization step size of the quantization unit.

Any of the variety of existing bit-allocation techniques may be used, including, e.g., water filling. In the water filling technique, (1) the quantization unit with the maximum NMR (Noise to Mask Ratio) is identified; (2) the quantization step size assigned to this quantization unit is reduced, thereby reducing quantization noise; and then (3) the foregoing two steps are repeated above until the NMRs of all quantization units are less than 1 (or other threshold set in advance), or until the bits which are allowed in the current frame are exhausted.

Quantization section 26 quantizes the subband samples, preferably by quantizing the samples in each quantization unit in a straightforward manner using a uniform quantization step size provided by global bit allocator 34, as described above. However, any other quantization technique instead may be used, with corresponding adjustments to global bit allocation section 34.

Code book selector 36 groups or segments the quantization indexes by the local statistical characteristic of such quantization indexes, and selects a code book from the code book library to assign to each such group of quantization indexes. In the preferred embodiments of the invention, the segmenting and code-book selection occur substantially simultaneously.

In the preferred embodiments of the invention, quantization index encoder 28 (discussed in additional detail below) performs Huffman encoding on the quantization indexes by using the code book selected by code book selector 36 for each respective segment. More preferably, Huffman encoding is performed on the subband sample quantization indexes in each channel. Still more preferably, two groups of code books (one for quasistationary frames and one for transient frames, respectively) are used to perform Huffman encoding on the subband sample quantization indexes, with each group of code books being made up of 9 Huffman code books. Accordingly, the preferred embodiments up to 9 Huffman code books can be used to perform encoding on the quantization indexes for a given frame. The properties of such code books preferably are as follows:

| Code Book Index (mnHS) | Dimension | Quantization Index Range | Midtread | Quasistationary Code Book Group | Transient Code Book Group |
|---|---|---|---|---|---|
| 0 | 0 | 0 | reserved | reserved | reserved |
| 1 | 4 | −1, 1 | Yes | HuffDec10_81x4 | HuffDec19_81x4 |
| 2 | 2 | −2, 2 | Yes | HuffDec11_25x2 | HuffDec20_25x2 |
| 3 | 2 | −4, 4 | Yes | HuffDec12_81x2 | HuffDec21_81x2 |
| 4 | 2 | −8, 8 | Yes | HuffDec13_289x2 | HuffDec22_289x2 |
| 5 | 1 | −15, 15 | Yes | HuffDec14_31x1 | HuffDec23_31x1 |
| 6 | 1 | −31, 31 | Yes | HuffDec15_63x1 | HuffDec24_63x1 |
| 7 | 1 | −63, 63 | Yes | HuffDec16_127x1 | HuffDec25_127x1 |
| 8 | 1 | −127, 127 | Yes | HuffDec17_255x1 | HuffDec26_255x1 |
| 9 | 1 | −255, 255 | No | HuffDec18_256x1 | HuffDec27_256x1 |

Other types of the entropy coding (such as arithmetic code) are performed in alternate embodiments of the invention. However, in the present examples it is assumed that Huffman encoding is used. As used herein, "Huffman" encoding is intended to encompass any prefix binary code that uses assumed symbol probabilities to express more common source symbols using shorter strings of bits than are used for less common source symbols, irrespective of whether or not the coding technique is identical to the original Huffman algorithm.

In view of the anticipated encoding to be performed by quantization index encoder 28, the goal of code book selector 36 in the preferred embodiments of the invention is to select segments of classification indexes in each channel and to determine which code book to apply to each segment. The first step is to identify which group of code books to use based on the frame type (quasistationary or transient) identified by transient analysis section 16. Then, the specific code books and segments preferably are selected in the following manner.

In conventional audio signal processing algorithms, the application range of an entropy code book is the same as the quantization unit, so the entropy code book is defined by the maximum quantization index in the quantization unit. Thus, there is no potential for further optimization.

In contrast, in the preferred embodiments of the present invention code book selection ignores the quantization unit boundaries, and instead simultaneously selects an appropriate code book and the segment to which it is to apply. More preferably, quantization indexes are divided into segments by their local statistical properties. The application range of the code book is defined by the edges of these segments. An example of a technique for identifying code book segments and corresponding code books is described with reference to the flow diagram shown in FIG. 2.

Initially, in step 82 initial sets of code book segments and corresponding code books are selected. This step may be performed in a variety of different ways, e.g., by using clustering techniques or by simply grouping together quantization indexes within a continuous interval that can only be accommodated by a code book of a given size. In this latter regard, among the group of applicable code books (e.g., nine different code books), the main difference is the maximum quantization index that can be accommodated. Accordingly, code book selection primarily involves selecting a code book that can accommodate the magnitudes of all of the quantization indexes under consideration. Accordingly, one approach to step 82 is to start with the smallest code book that will accommodate the first quantization index and then keep using it until a larger code book is required or until a smaller one can be used.

Figure 3:
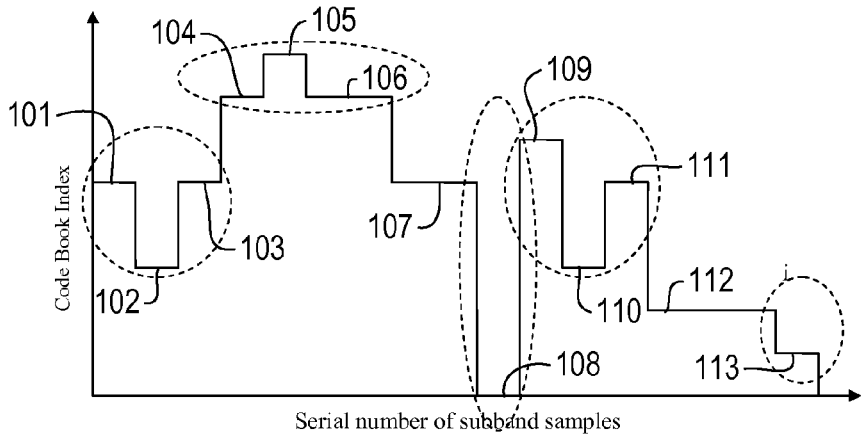
FIG. 3 illustrates an example of a sequence of quantization indexes divided into code book segments with corresponding code books identified according to a representative embodiment of the present invention.

In any event, the result of this step 82 is to provide an initial sequence of code book segments and corresponding code books. One example includes segments 101-113 shown in FIG. 3. Here, each code segment 101-103 has a length indicated by its horizontal length in an assigned code book represented by its vertical height.

Next, in step 83 code book segments are combined as necessary or desirable, again, preferably based on the magnitudes of the quantization indexes. In this regard, because the code book segments preferably can have arbitrary boundaries, the locations of those boundaries typically must be transmitted to the decoder. Accordingly, if the number of the code book segments is too great after step 82, it is preferable to eliminate some of the small code book segments until a specified criterion 85 is satisfied.

Figure 4:
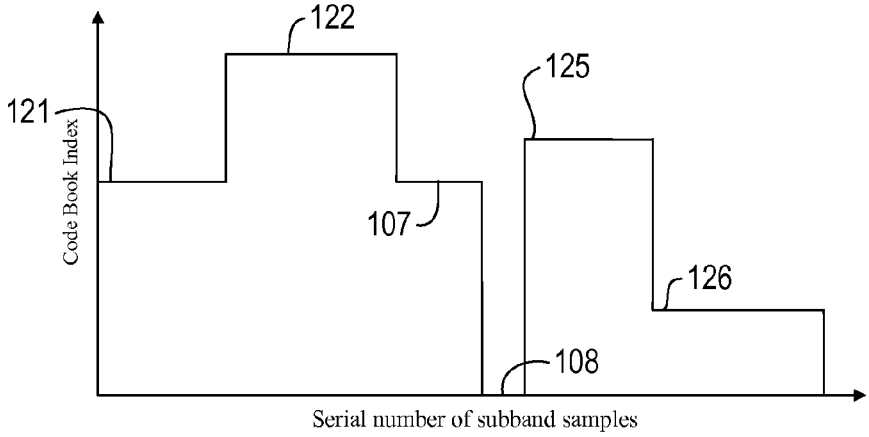
FIG. 4 a resulting segmentation of quantization indexes into code book segments after eliminating segments from the segmentation shown in FIG. 3, according to a representative embodiment of the present invention.

In the preferred embodiments, the elimination method is to combine small code book segments (e.g., the shortest code book segments) with the code book segment having the smallest code book index (corresponding to the smallest code book) to the left and right sides of the code book segment under consideration. FIG. 4 provides an example of the result of applying this step 83 to the code book segmentation shown in FIG. 3. In this case, segment 102 has been combined with segments 101 and 103 (which use the same code book) to provide segment 121, segments 104 and 106 have been combined with segment 105 to provide segment 122, segments 110 and 111 have been combined with segment 109 to provide segment 125, and segment 113 has been combined with segment 112 to provide segment 126. If the code book index equals 0 (e.g. for segment 108), no quantization index is required to be transmitted, so such isolated code book segments preferably are not rejected. Accordingly, in the present example code book segment 108 is not rejected.

Figure 2:
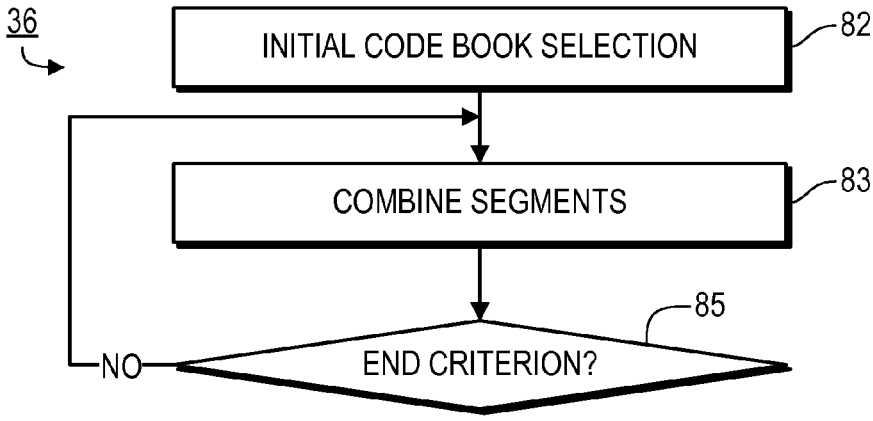
FIG. 2 is a flow diagram illustrating a process for identifying an initial set of code book segments and corresponding code books according to a representative embodiment of the present invention.

As shown in FIG. 2, step 83 preferably is repeatedly applied until the end criterion 85 has been satisfied. Depending upon the particular embodiment, the end criterion might include, e.g., that the total number of segments does not exceed a specified maximum, that each segment has a minimum length and/or that the total number of code books referenced does not exceed a specified maximum. In this iterative process, the selection of the next segment to eliminate may be made based upon a variety of different criterion, e.g., the shortest existing segment, the segment whose code book index could be increased by the smallest amount, the smallest projected increase in the number of bits, or the overall net benefit to be obtained (e.g., as a function of the segment's length and the required increase in its code book index).

Figure 5:
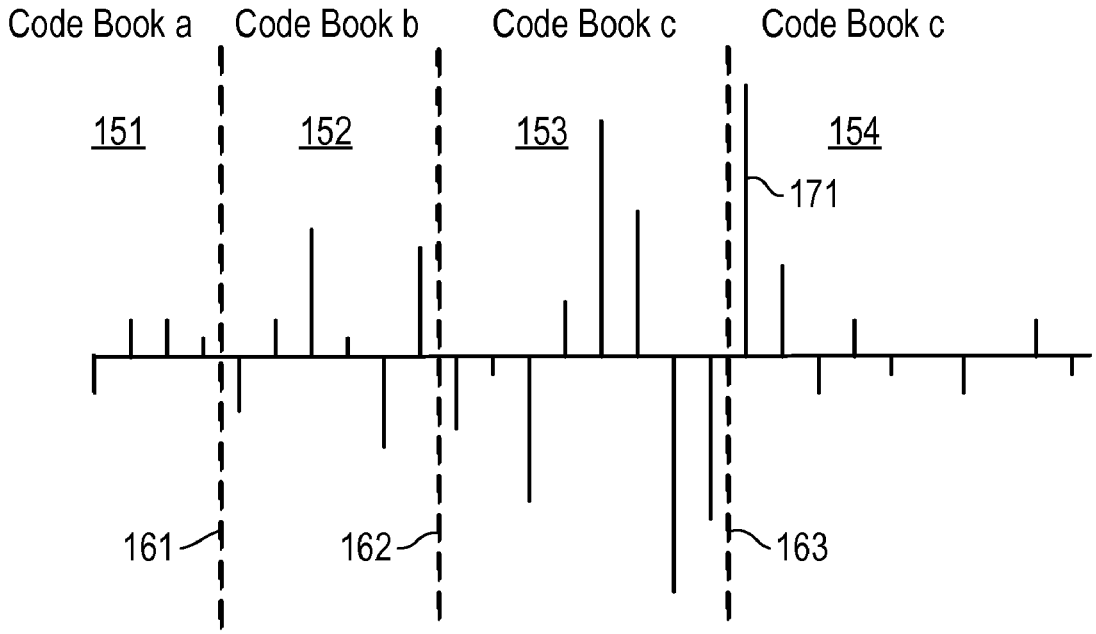
FIG. 5 (Prior Art)
FIG. 5 illustrates the results of a conventional quantization index segmentation, in which quantization segments correspond directly to quantization units.
Figure 6:
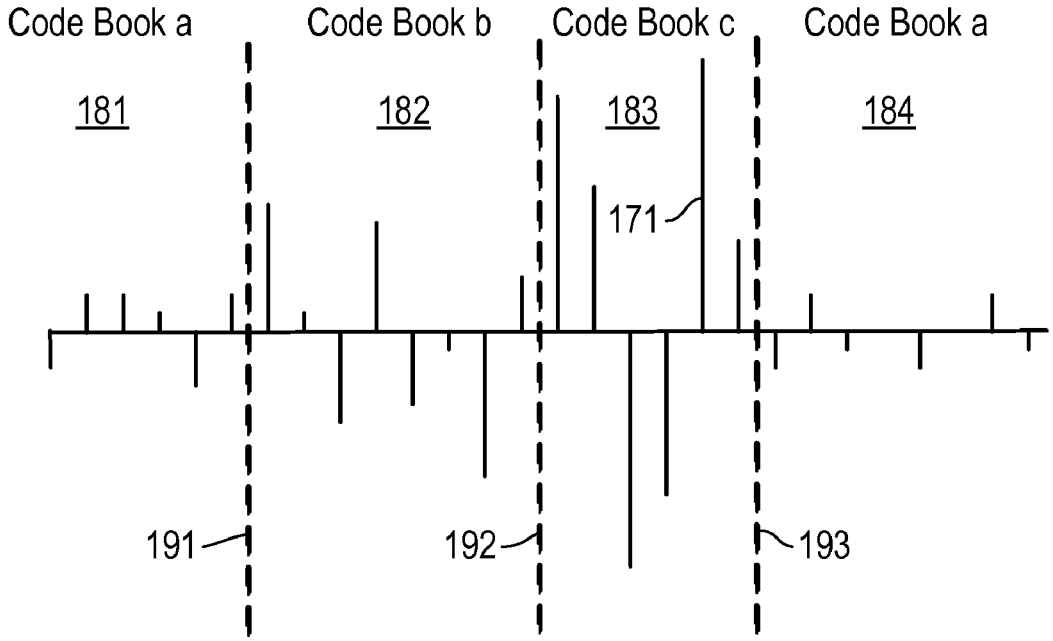
FIG. 6 illustrates the results of quantization index segmentation according to a representative embodiment of the present invention, in which quantization indexes are grouped together in an efficient manner.

Advantages of this technique can be appreciated when comparing a conventional segmentation, as illustrated in FIG. 5, with a segmentation according to the present invention, as shown in FIG. 6. In FIG. 5, the quantization indexes have been divided into four quantization segments 151-154, having corresponding right-side boundaries 161-163. In accordance with the conventional approach, the quantization segments 151-154 correspond directly to the quantization units. In this example, the maximum quantization index 171 belongs to quantization unit 154. Accordingly, a large code book (e.g., code book c) must be selected for quantization unit 154. It is not a wise choice, because most of quantization indexes of quantization unit 154 are small.

In contrast, when the technique of the present convention is applied, the same quantization indexes are segmented into code book segments 181-184 using the technique described above. As a result, the maximum quantization index 171 is grouped with the quantization indexes in code book segment 183 (which already would have been assigned code book segment c based on the magnitudes of the other quantization indexes within it). Although this quantization index 171 still requires a code book of the same size (e.g., code book c), it shares this code book with other large quantization indexes. That is, this large code book is matched to the statistical properties of the quantization indexes in this code book segment 183. Moreover, because all of the quantization indexes within code book segment 184 are small, then a smaller code book (e.g., code book a) is selected for it, i.e., matching the code book with the statistical properties of quantization indexes in it. As will be readily appreciated, the technique of code book selection often can reduce the number of bits used to transmit quantization indexes.

As noted above, however, there is some "extra cost" associated with using this technique. Conventional techniques generally only require transmitting the side information of codebook indexes to the decoder, because their application range is the same as the quantization unit. However, the present technique generally requires not only transmitting the side information of codebook indexes, but also transmitting the application range to the decoder, because the application range and the quantization units typically are independent. In order to address this problem, in certain embodiments the present technique defaults to the conventional approach (i.e., simply using the quantization units as of the quantization segments) if such "extra cost" cannot be compensated, which is expected to occur only rarely, if at all. As noted above, one approach to addressing this problem is to divide into code book segments that are as large as possible under the condition of the statistical property allowed.

Upon completion of the processing by code book selector 36, the number of segments, length (application range for each code book) of each segment, and the selected code book index for each segment preferably are provided to multiplexer 45 for inclusion within the bit stream.

Quantization index encoder 28 performs compression encoding on the quantization indexes using the segments and corresponding code books selected by code book selector 36. The maximum quantization index, i.e., 255, in code book HuffDec18_256×1 and in code book HuffDec27_256×1 (corresponding to code book index 9) represents ESCAPE. Because the quantization indexes potentially can exceed the maximum range of the two code table, such larger indexes are encoded using recursive encoding, with q being represented as:

$$q=m*255+r$$

where m is the quotient of q and r is the remainder of q. The remainder r is encoded using the Huffman code book corresponding to code book index 9, while the quotient q is packaged into the bit stream directly. Huffman code books preferably are used to perform encoding on the number of bits used for packaging the quotient q.

Because code book HuffDec18_256×1 and code book HuffDec27_256×1 are not midtread, when the absolute values are transmitted, an additional bit is transmitted for representing the sign. Because the code books corresponding to code book indexes 1 through 8 are midtread, the offset is added to reconstruct the quantization index sign after Huffman decoding.

Multiplexer 45 packages all the Huffman codes, together with all additional information mentioned above and any user-defined auxiliary information into a single bit stream 60. In addition, an error code preferably is inserted for the current frame of audio data. More preferably, after the encoder 10 packages all of the audio data, all of idle bits in the last word (32 bits) are set to 1. At the decoder side, if all of the idle bits do not equal 1, then an error is declared in the current frame and an error handling procedure is initiated.

In the preferred embodiments of the invention, because the auxiliary data are located behind the error-detection code, the decoder can stop and wait for the next audio frame after finishing code error detection. In other words, the auxiliary data have no effect on the decoding and need not be dealt with by decoder. As a result, the definition and the understanding of the auxiliary data can be determined entirely by the users, thereby giving the users a significant amount of flexibility.

The output structure for each frame preferably is as follows:

| | |
|---|---|
| Frame Header | Synchronization word (preferably, 0x7FFF) Description of the audio signal, such as sample rate, the number of normal channels, the number of LFE channels and so on. |
| Normal Channels: 1 to 64 | Audio data for all normal channels |
| LFE Channels: 0 to 3 | Audio data for all LFE channels |
| Error Detection | Error-detection code for the current frame of audio data. When detected, the error-handling program is run. |
| Auxiliary Data | Time code and/or any other user-defined information |

The data structure for each normal channel preferably is as follows:

| | | |
|---|---|---|
| Window Sequence | Window function index | Indicate MDCT window function |
| | The number of transient segments | Indicate the number of transient segments—only used for a transient frame. |
| | Transient segment length | Indicate the lengths of the transient segments—only used for a transient frame |
| Huffman Code Book Index and Application Range | The number of code books | The number of Huffman code books which each transient segment uses |
| | Application range | Application range of each Huffman code book |
| | Code book index | Code book index of each Huffman code book |
| Subband Sample Quantization Index | Quantization indexes of all subband samples | |
| Quantization Step Size Index | Quantization step size index of each quantization unit | |
| Sum/Difference encoding Decision | Indicate whether the decoder should perform sum/difference decoding on the samples of a quantization unit. | |
| Joint Intensity Coding Scale Factor Index | Indexes for the scale factors to be used to reconstruct subband samples of the joint quantization units from the source channel. | |

The data structure for each LFE channel preferably is as follows:

| | | |
|---|---|---|
| Huffman Code Book Index and Application Range | The number of code books | Indicate the number of code books. |
| | Application range | Application range of each Huffman code book. |
| | Code book index | Code book index of each Huffman code book. |
| Subband Sample Quantization Index | Quantization indexes of all subband samples. | |
| Quantization Step Size Index | Quantization step size indexes of each quantization unit. | |

System Environment.

Generally speaking, except where clearly indicated otherwise, all of the systems, methods and techniques described herein can be practiced with the use of one or more programmable general-purpose computing devices. Such devices typically will include, for example, at least some of the following components interconnected with each other, e.g., via a common bus: one or more central processing units (CPUs); read-only memory (ROM); random access memory (RAM); input/output software and circuitry for interfacing with other devices (e.g., using a hardwired connection, such as a serial port, a parallel port, a USB connection or a firewire connection, or using a wireless protocol, such as Bluetooth or a 802.11 protocol); software and circuitry for connecting to one or more networks (e.g., using a hardwired connection such as an Ethernet card or a wireless protocol, such as code division multiple access (CDMA), global system for mobile communications (GSM), Bluetooth, a 802.11 protocol, or any other cellular-based or non-cellular-based system), which networks, in turn, in many embodiments of the invention, connect to the Internet or to any other networks); a display (such as a cathode ray tube display, a liquid crystal display, an organic light-emitting display, a polymeric light-emitting display or any other thin-film display); other output devices (such as one or more speakers, a headphone set and a printer); one or more input devices (such as a mouse, touchpad, tablet, touch-sensitive display or other pointing device, a keyboard, a keypad, a microphone and a scanner); a mass storage unit (such as a hard disk drive); a real-time clock; a removable storage read/write device (such as for reading from and writing to RAM, a magnetic disk, a magnetic tape, an opto-magnetic disk, an optical disk, or the like); and a modem (e.g., for sending faxes or for connecting to the Internet or to any other computer network via a dial-up connection). In operation, the process steps to implement the above methods and functionality, to the extent performed by such a general-purpose computer, typically initially are stored in mass storage (e.g., the hard disk), are downloaded into RAM and then are executed by the CPU out of RAM. However, in some cases the process steps initially are stored in RAM or ROM.

Suitable devices for use in implementing the present invention may be obtained from various vendors. In the various embodiments, different types of devices are used depending upon the size and complexity of the tasks. Suitable devices include mainframe computers, multiprocessor computers, workstations, personal computers, and even smaller computers such as PDAs, wireless telephones or any other appliance or device, whether stand-alone, hard-wired into a network or wirelessly connected to a network.

In addition, although general-purpose programmable devices have been described above, in alternate embodiments one or more special-purpose processors or computers instead (or in addition) are used. In general, it should be noted that, except as expressly noted otherwise, any of the functionality described above can be implemented in software, hardware, firmware or any combination of these, with the particular implementation being selected based on known engineering tradeoffs. More specifically, where the functionality described above is implemented in a fixed, predetermined or logical manner, it can be accomplished through programming (e.g., software or firmware), an appropriate arrangement of logic components (hardware) or any combination of the two, as will be readily appreciated by those skilled in the art.

It should be understood that the present invention also relates to machine-readable media on which are stored program instructions for performing the methods and functionality of this invention. Such media include, by way of example, magnetic disks, magnetic tape, optically readable media such as CD ROMs and DVD ROMs, or semiconductor memory such as PCMCIA cards, various types of memory cards, USB memory devices, etc. In each case, the medium may take the form of a portable item such as a miniature disk drive or a small disk, diskette, cassette, cartridge, card, stick etc., or it may take the form of a relatively larger or immobile item such as a hard disk drive, ROM or RAM provided in a computer or other device.

The foregoing description primarily emphasizes electronic computers and devices. However, it should be understood that any other computing or other type of device instead may be used, such as a device utilizing any combination of electronic, optical, biological and chemical processing.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A method of encoding an audio signal, comprising:

(a) obtaining a sampled audio signal which is divided into frames;

(b) identifying: (i) at least a portion of a transient within one of the frames, the transient including an attack followed by a fall and the identified portion including the attack or the fall, (ii) a first portion of said frame that includes samples before said identified attack or fall, and (iii) a second portion of said frame that includes samples after said identified attack or fall;

(c) generating transform data samples by performing multi-resolution filter bank analysis on the frame data, including filtering the first portion at a different resolution than the second portion;

(d) generating quantization data by quantizing the transform data samples using variable numbers of bits based on a psychoacoustical model;

(e) grouping the quantization data into variable-length segments based on magnitudes of the quantization data;

(f) assigning a code book to each of the variable-length segments; and (g) encoding the quantization data in each of the variable-length segments using the code book assigned to set the variable-length segment.

2. A method according to claim 1, wherein the transform data samples comprise at least one of (i) a sum of corresponding data values for two different channels and (ii) a difference between data values for two different channels.

3. A method according to claim 1, wherein at least some of the transform data samples have been joint intensity encoded.

4. A method according to claim 1, wherein the transform data samples are generated by performing a Modified Discrete Cosine Transform.

5. A method according to claim 1, wherein filtering within said one of the frames that includes said at least a portion of the transient comprises applying a filter bank to each of a plurality of equal-sized contiguous transform blocks.

6. A method according to claim 5, wherein filtering within said one of the frames that includes said at least a portion of the transient comprises applying a different window function to one of the transform blocks that includes said at least a portion of the transient than is applied to the transform blocks that do not include said at least a portion of the transient.

7. A method according to claim 1, wherein the encoding in step (g) comprises Huffman encoding, utilizing a first codebook group comprising 9 code books for frames that do not include at least a portion of a detected transient signal and a second code-book group comprising 9 code books for frames that include at least a portion of a detected transient signal.

8. A method according to claim 1, wherein said step (e) comprises an iterative technique of combining shorter segments of quantization data into adjacent segments.

9. A method according to claim 1, wherein the quantization data are generated by assigning a fixed number of bits to each sample within each of a plurality of quantization units, with different quantization units having different numbers of bits per sample, and wherein the variable-length segments are independent of the quantization units.

10. A method according to claim 1, wherein steps (e) and (f) are performed simultaneously.

11. A non-transitory computer-readable medium storing computer-executable process steps for encoding an audio signal, wherein said process steps comprise:

(a) obtaining a sampled audio signal which is divided into frames;

(b) identifying: (i) at least a portion of a transient within one of the frames, the transient including an attack followed by a fall and the identified portion including the attack or the fall, (ii) a first portion of said frame that includes samples before said identified attack or fall, and (iii) a second portion of said frame that includes samples after said identified attack or fall;

(c) generating transform data samples by performing multi-resolution filter bank analysis on the frame data, including filtering the first portion at a different resolution than the second portion;

(d) generating quantization data by quantizing the transform data samples using variable numbers of bits based on a psychoacoustical model;

(e) grouping the quantization data into variable-length segments based on magnitudes of the quantization data;

(f) assigning a code book to each of the variable-length segments; and (g) encoding the quantization data in each of the variable-length segments using the code book assigned to set the variable-length segment.

12. A non-transitory computer-readable medium according to claim 11, wherein the transform data samples comprise at least one of (i) a sum of corresponding data values for two different channels and (ii) a difference between data values for two different channels.

13. A non-transitory computer-readable medium according to claim 11, wherein at least some of the transform data samples have been joint intensity encoded.

14. A non-transitory computer-readable medium according to claim 11, wherein the transform data samples are generated by performing a Modified Discrete Cosine Transform.

15. A non-transitory computer-readable medium according to claim 11, wherein filtering within said one of the frames that includes said at least a portion of the transient comprises applying a filter bank to each of a plurality of equal-sized contiguous transform blocks.

16. A non-transitory computer-readable medium according to claim 15, wherein filtering within said one of the frames that includes said at least a portion of the transient comprises applying a different window function to one of the transform blocks that includes said at least a portion of the transient than is applied to the transform blocks that do not include said at least a portion of the transient.

17. A non-transitory computer-readable medium according to claim 11, wherein the encoding in step (g) comprises Huffman encoding, utilizing a first code-book group comprising 9 code books for frames that do not include at least a portion of a detected transient signal and a second code-book group comprising 9 code books for frames that include at least a portion of a detected transient signal.

18. A non-transitory computer-readable medium according to claim 11, wherein said step (e) comprises an iterative technique of combining shorter segments of quantization data into adjacent segments.

19. A non-transitory computer-readable medium according to claim 11, wherein the quantization data are generated by assigning a fixed number of bits to each sample within each of a plurality of quantization units, with different quantization units having different numbers of bits per sample, and wherein the variable-length segments are independent of the quantization units.

20. A non-transitory computer-readable medium according to claim 11, wherein steps (e) and (f) are performed simultaneously.

* * * * *

UNITED STATES PATENT AND TRADEMARK OFFICE

CERTIFICATE OF CORRECTION

PATENT NO. : 7,895,034 B2
APPLICATION NO. : 11/669346
DATED : February 22, 2011
INVENTOR(S) : Yuli You It is certified that error appears in the above-identified patent and that said Letters Patent is hereby corrected as shown below:

In column 5 line 22, change “each transitent segment” to --each transient segment--.

In column 5 line 24, change “The results often is” to --The result often is to--.

In column 5 line 52, change “Once again, the subband samples” to --Once again, the linear sequence for the subband samples--.

In column 6 line 28, change “Each critical band can be represent as” to --Each critical band can be represented as--.

Signed and Sealed this
Seventeenth Day of May, 2011

David J. Kappos

David J. Kappos
*Director of the United States Patent and Trademark Office*